United States Patent [19]

Macaluso

[11] Patent Number: 4,976,374

[45] Date of Patent: Dec. 11, 1990

[54] PACKING CONTAINER

[75] Inventor: Vincent A. Macaluso, Trappe, Pa.

[73] Assignee: Cornerboard, Inc., Bridgeport, Pa.

[21] Appl. No.: 501,955

[22] Filed: Mar. 29, 1990

Related U.S. Application Data

[63] Continuation of Ser. No. 180,187, Apr. 11, 1988, abandoned.

[51] Int. Cl.[5] ..... B65D 1/40

[52] U.S. Cl. ..... 220/453; 220/468; 229/23 R; 229/23 BT; 229/125.22

[58] Field of Search ..... 229/23 R, 23 BT, 125.21, 229/125.22, 125.38; 220/453, 468, 4 R

[56] References Cited

U.S. PATENT DOCUMENTS

| | | | |
|---|---|---|---|
| 1,758,230 | 5/1930 | Lange | 229/DIG. 4 |
| 2,194,669 | 3/1940 | Mumsford | 229/23 R |
| 2,319,641 | 5/1943 | Speir, Jr. | 229/DIG. 4 |
| 3,007,622 | 11/1961 | George | 229/23 R |
| 3,041,717 | 7/1962 | Brown | 220/468 |
| 3,370,777 | 2/1968 | Levi | 229/23 R |
| 3,486,612 | 12/1969 | Kivell | 229/23 BT |
| 3,543,994 | 12/1970 | Clark | 229/23 BT |
| 3,669,338 | 6/1972 | Cornell et al. | 229/23 BT |
| 4,157,138 | 6/1979 | Duncan | 229/23 BT |
| 4,349,124 | 9/1982 | Faller | 220/453 |

FOREIGN PATENT DOCUMENTS

| | | | |
|---|---|---|---|
| 14545 | 7/1929 | Australia | 229/23 R |
| 697675 | 11/1964 | Canada | 229/23 R |
| 20171 | 12/1980 | European Pat. Off. | 229/23 R |
| 808228 | 2/1937 | France | 229/23 R |
| 1186056 | 8/1959 | France | 229/23 R |
| 1217887 | 5/1960 | France | 229/23 R |

*Primary Examiner*—Gary E. Elkins

*Attorney, Agent, or Firm*—Ratner & Prestia

[57] ABSTRACT

A packing container for lengthy articles in which U-shaped base and cover units, formed from laminated paperboard, are arranged so that the sidewalls of the base unit fit within the sidewalls of the cover unit when the two are assembled. End caps close off the open ends of the container when the base unit and the cover unit area assembled.

11 Claims, 2 Drawing Sheets

PACKING CONTAINER

This application is a continuation of application Ser. No. 07/180,187 filed Apr. 11, 1988.

TECHNICAL FIELD

The present invention relates, in general, to packaging and, in particular, to a paperboard packing container for lengthy articles.

BACKGROUND ART

Various constructions have been used in the past to package lengthy articles. One such construction includes a pair of corrugated paperboard top and bottom U-shaped channels arranged for one to fit within the other with end caps fitted into the open ends of the assembly of the U-shaped channels.

One major or shortcoming in using corrugated paperboard as the packaging material for long packing containers is inadequate strength and stability, particularly when the articles being packed are heavy. Another problem is with the assembly of the containers. Corrugated paperboard blanks with scored fold lines which are folded into U-channels, five panel, or fan fold folders are awkward to handle, as they are assembled into containers, because they do not keep their assembled shape. It is apparent that this problem becomes more pronounced the longer the packing container.

Another packing construction currently in use is preformed round paper tubes. Among the problems with such containers are that they must be end-loaded and because they are circular, they roll around and stacking is, at best, difficult.

Wooden crates also are used as packing containers at the present time. Besides being expensive, wooden crates are heavy, making handling difficult and adding to shipping costs. In addition, because wooden crates cannot be recycled, disposal is a problem.

DISCLOSURE OF THE INVENTION

Accordingly, a packing container, constructed in accordance with the present invention, includes a base unit and a cover unit each formed of laminated paperboard and having a U-shaped cross-section. The base unit and the cover unit are sized so that upon assembly into a container, the sidewalls of the base unit are fitted within and embrace the side walls of the cover unit. Also included in the packing container are end caps which close off the opposite open ends of the container formed where the base unit and the cover unit are assembled.

In one embodiment of the invention, the end caps are separate components preferably formed of laminated paperboard and having a U-shaped cross-section. In another embodiment of the invention, the sidewalls of the cover unit are notched near their ends and the end caps are end sections of the cover unit folded downward at the notches in the sidewalls. In a third embodiment of the invention, the cover unit is shorter than the base unit and each end cap is integral with and folded down from a section which is fitted over the base unit.

BRIEF DESCRIPTION OF THE DRAWINGS

Referring to the drawings.

BEST MODES OF CARRYING OUT THE INVENTION

Figure 1:
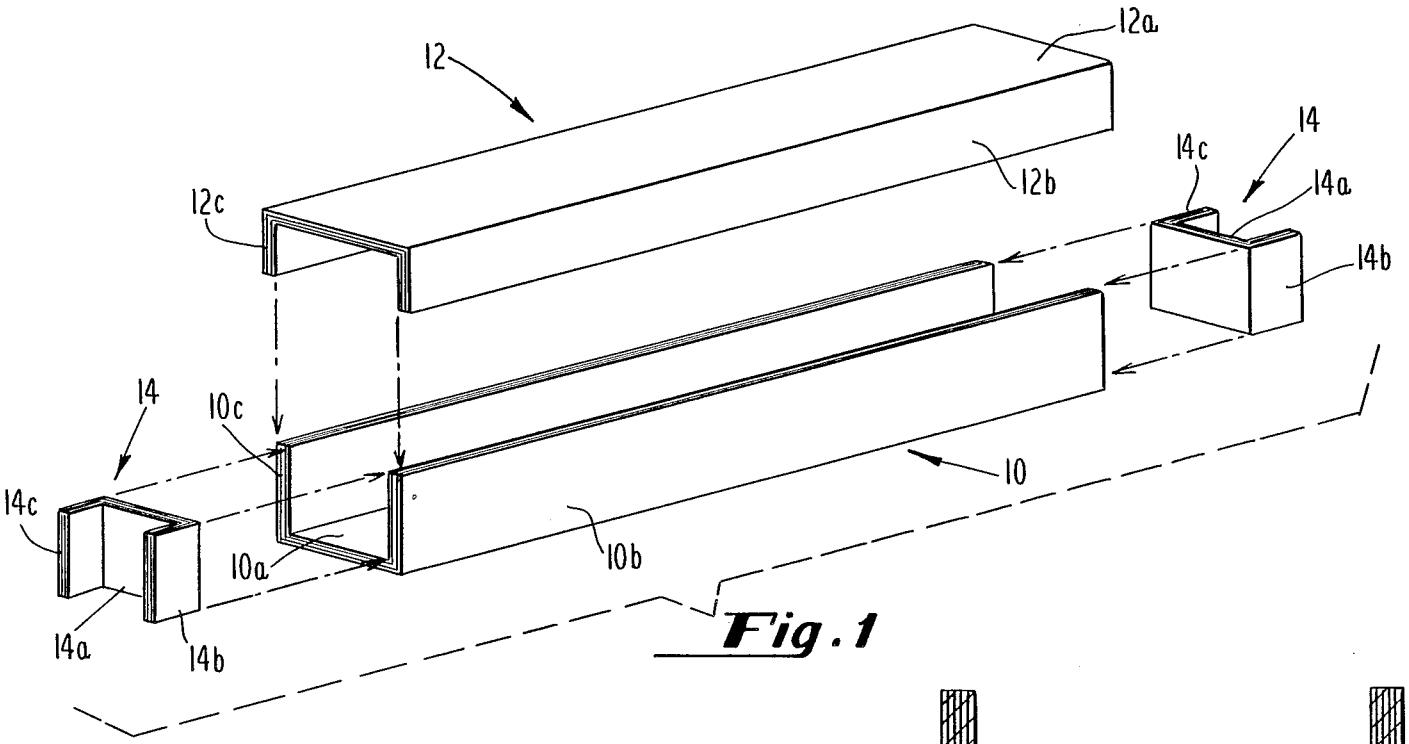
FIG. 1 is an exploded, perspective view of a first embodiment of a packing container constructed in accordance with the present invention.
Figure 2:
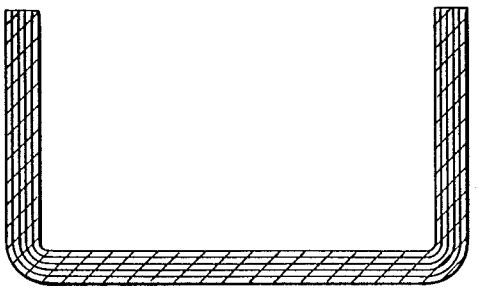
FIG. 2 is a cross-section view of any of the U-shaped components of FIG. 1.
Figure 3:
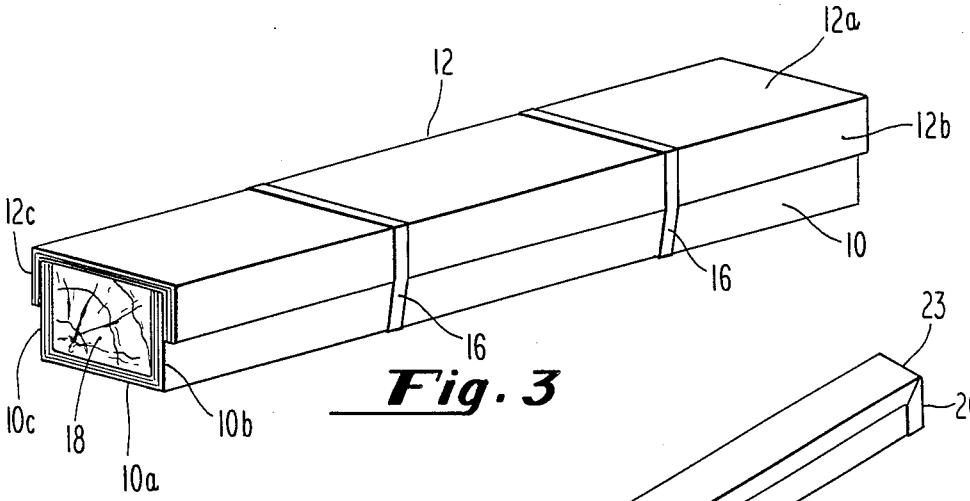
FIG. 3 is a perspective view of the FIG. 1 base unit and cover unit after assembly with solid end caps substituted for the FIG. 1 end caps.

Referring to FIGS. 1, 2 and 3, a packing container, constructed in accordance with the present invention, includes a base unit 10 formed of laminated paperboard and having a bottom portion 10*a* and opposed sidewalls 10*b* and 10*c*, to form a laminated U-shaped cross-section. Also included is a cover unit 12 formed of laminated paperboard and having a top portion 12*a* and opposed sidewalls 12*b* and 12*c* to form a laminated U-shaped cross-section. Base unit 10 and cover unit 12 are sized so that upon assembly into a container, as illustrated in FIG. 3, the upper edges of the outside surfaces of sidewalls 10*b* and 10*c* of base unit 10 fit within and embrace sidewalls 12*b* and 12*c*, respectively, of cover unit 12.

The packing container shown in FIGS. 1 and 3 further includes a pair of end caps which close off opposite open ends of the container formed when base unit 10 and cover unit 12 are assembled as a container. In FIG. 1, each end cap 14 is formed of laminated paperboard and includes a base portion 14*a* and two opposed sidewalls 14*b* and 14*c* to form a laminated U-shaped cross-section. Base portion 14*a* and sidewalls 14*b* and 14*c* extend between bottom portion 10*a* of base unit 10 and top portion 12*a* of cover unit 12.

End caps 14 are inserted in the opposite open ends of the assembly of base unit 10 and cover unit 12 with base portions 14*a* of the end caps inward of sidewalls 14*b* and 14*c* relative to the open ends of the assembly. In this way, the three layers of laminated paperboard material at each corner of the packing container, namely a sidewall of base unit 10, a sidewall of cover unit 12, and a sidewall of an end cap 14, can be stapled to secure together the components of the packing container.

Conventional bands 16 can be used to tie together base unit 10 and cover unit 12 at selected points along the length of the packing container. In the alternative, base unit 10, cover unit 12 and end caps 14 can be glued together as they are assembled into the packing container.

FIG. 2, showing a laminated paperboard formed into a laminated U-shaped cross-section, can represent the cross-sections of base unit 10, cover unit 12 or end caps 14. Those skilled in the art of manufacturing packaging container components will appreciate that by forming all four components, namely base unit 10, cover unit 12, and end caps 14 as U-shaped members made from the same laminated paperboard material, the same machine can be used to produce these parts but with different dies to form the three differently sized U-shaped members. However, it is understood that other components can be employed as end caps. For example, as illustrated in FIG. 3, the end caps can be solid members, such as a block 18, made from wood or styrofoam, which is held in place by suitable means, such as by glue or bands tightly wrapped around the ends of base unit 10 and cover unit 12.

Figure 4:
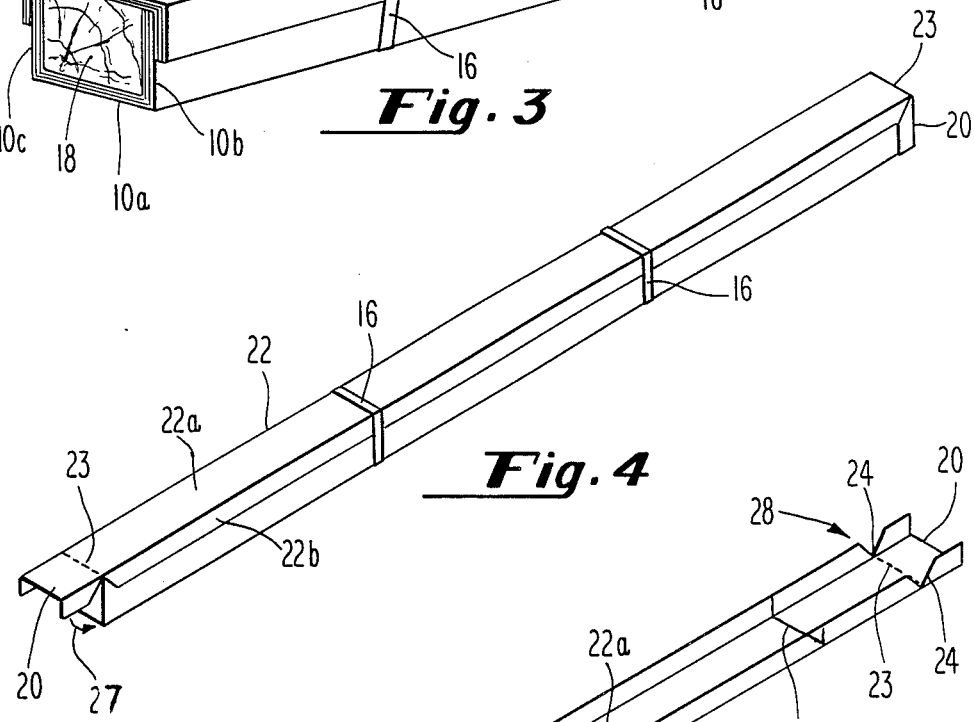
FIG. 4 is a perspective view of a second embodiment of a packing container constructed in accordance with the present invention.
Figure 5:
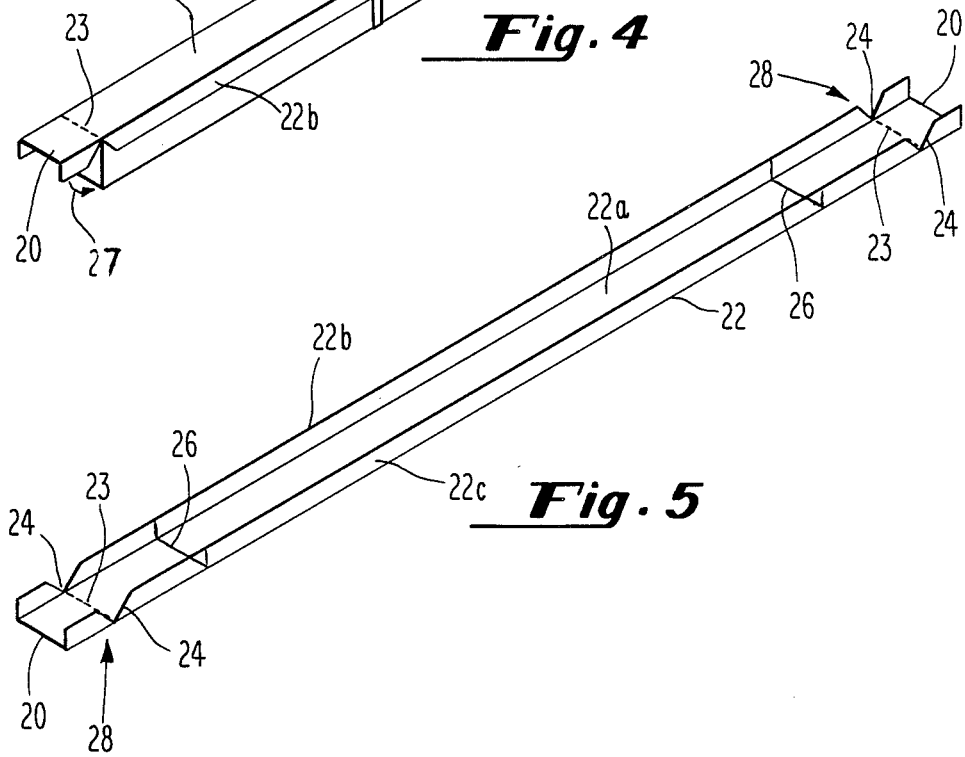
FIG. 5 is a perspective view of the top unit of FIG. 4 inverted.

FIGS. 4 and 5 show a second embodiment of a packing container constructed in accordance with the present invention. This embodiment differs from the first embodiment in that the cover unit and the end caps are arranged to form mitered corners. In one version of this embodiment of the invention, end caps 20 are integral with cover unit 22 and are end sections of the cover unit which extend downward from top portion 22*a* of the cover unit when folded into place along fold lines 23 to form the packing container. Sidewalls 22*b* and 22*c* have V-notches 24 spaced inward from the ends of cover unit 22 by a distance equal to the distance between top portion 22*a* of the cover unit and bottom portion 10*a* of base unit 10. V-notches 24, having a 90° included angle, extend to the junctions of sidewalls 22*b* and 22*c* with top portion 22*a*. With cover unit 22 and base unit 10 assembled, end caps 22 are folded downward, as indicated by an arrow 26, along fold lines 23 to close off the opposite open ends of the container as indicated at the right-hand end of the container of FIG. 4. In this position, the sidewalls of end sections of cover unit 22 outward of V-notches 24 embrace the end edges of the outside surfaces of the sidewalls of base unit 10. End caps 20 can be held in place by suitable means, such as by glue or bands tightly wrapped around the ends of base unit 10 and cover unit 22. As with the FIGS. 1 and 3 embodiment of the invention, bands 16 can be used to tie together unit 10 and cover unit 22 or these parts can be glued together as they are assembled into the packing container.

Instead of fabricating the cover unit and the end caps as a single component with notched sidewalls, the end caps and the cover unit can be fabricated as separate components. When fabricated in this way, both ends of the sidewalls of the cover unit are cut at an angle and one end of the sidewalls of each of the end caps are cut at an angle, whereby two mitered corners are formed by the cover unit and the end caps.

In yet another version of the FIGS. 4 and 5 embodiment of the present invention, the cover unit is shorter than the base unit. This is represented by the dashed lines in FIG. 5 identified by reference numerals 26. With a shorter cover unit, the container includes a pair of end members 28 of U-shaped cross-section at opposite ends of the base unit. Each end member 28 has V-notches 24 in its sidewalls with a first length to one side of the V-notches fitted over the base unit with its sidewalls embracing the upper edges of the outside surfaces of the sidewalls of the base unit. A second length of each end member 28 to the other side of V-notches 24 is folded downward with its sidewalls embracing the end edges of the outside surfaces of the sidewalls of the base unit. Each end member 28 is sized so that with the first length abutting against the cover unit, it extends to the end of the base unit. The second length of each end member extends downward to the bottom portion of the base unit.

While in the foregoing there have been described preferred embodiments of the present invention, it should be understood to those skilled in the art that various modifications and changes can be made without departing from the true spirit and scope of the invention as recited in the claims.

I claim:

1. A packing container comprising:

a preformed, rigid, laminated paperboard base unit of U-shaped cross-section laminated throughout its entire cross-section and having a bottom portion and opposed sidewalls;

and a preformed, rigid, laminated paperboard cover unit of U-shaped cross-section laminated throughout its entire cross-section and having a top portion and opposed sidewalls, said cover unit so sized that said sidewalls of said base unit are fitted within and embrace said sidewalls of said cover unit when said base unit and said cover unit are assembled as a container.

2. A packing container according to claim 1 further including a pair of end caps closing off opposite open ends of said container formed when said base unit and said cover unit are assembled.

3. A packing container comprising:

a preformed, rigid, laminated paperboard base unit of U-shaped cross-section laminated throughout its entire cross-section and having a bottom portion and opposed sidewalls;

a preformed, rigid, laminated paperboard cover unit of U-shaped cross-section laminated throughout its entire cross-section and having a top portion and opposed sidewalls, said sidewalls of said base unit fitted within and embracing said sidewalls of said cover unit when said base unit and said cover unit are assembled as a container;

and a pair of end caps closing off opposite open ends of said container formed when said base unit and said cover unit are assembled.

4. A packing container according to claim 3 wherein each of said end caps is formed of laminated paperboard and has (a) a base portion extending between said bottom portion of said base unit and said top portion of said cover unit and (b) two opposed sidewalls extending between said bottom portion of said base unit and said top portion of said cover unit to form a laminated U-shaped cross-section.

5. A packing container according to claim 4 wherein each of said end caps is a separate component and said sidewalls of each said end cap are fitted within and embrace the inside surfaces of said sidewalls of said base unit.

6. A packing container according to claim 5 wherein said base portion of each said end cap is inward of said sidewalls of said end cap relative to the open ends of said container.

7. A packing container according to claim 3 wherein each of said end caps is a solid member.

8. A packing container comprising:

a base unit formed of laminated paperboard and having a bottom portion and opposed sidewalls to form a laminated U-shaped cross-section;

and a cover unit formed of laminated paperboard and having a top portion and opposed sidewalls to form a laminated U-shaped cross-section, said sidewalls of said base unit fitted within and embracing said sidewalls of said cover unit when said base unit and said cover unit are assembled as a container, said sidewalls of said cover unit having V-notches extending to the junctions of said sidewalls with said top portion of said cover unit spaced inward from the ends of said cover unit by a distance equal to the distance between said top portion of said cover unit and said bottom portion of said base unit, and the end sections of said cover unit outward of said V-notches folded downward from said top portion of said cover unit forming opposite laminated U-shaped cross-section end caps closing off open ends of said container formed when said base unit and said cover unit are assembled with the sidewalls of said folded-down section embracing the outside surfaces of said sidewalls of said base unit.

9. A packing container comprising:

a base unit formed of laminated paperboard and having a bottom portion and opposed sidewalls to form a laminated U-shaped cross-section;

a cover unit formed of laminated paperboard and having a top portion and opposed sidewalls to form a laminated U-shaped cross-section, said sidewalls of said base unit fitted within and embracing said sidewalls of said cover unit when said base unit and said cover unit are assembled as a container;

and a pair of end caps formed as separate components and closing off opposite open ends of said container formed when said base unit and said cover unit are assembled, each of said end caps formed of laminated paperboard and having (a) a base portion extending between said bottom portion of said base unit and said top portion of said cover unit, and (b) two opposed sidewalls extending between said bottom portion of said base unit and said top portion of said cover unit to form a laminated U-shaped cross-section, said sidewalls of each said end cap embracing the outside surface of said sidewalls of said base unit.

10. A packing container according to claim 9 wherein (a) said sidewalls of said cover unit are cut at an angle at both ends, and (b) said sidewalls of each said end cap are cut at an angle at one end, whereby two mitered corners are formed by said cover unit and said end caps.

11. A packing container comprising:

a base unit formed of laminated paperboard and having a bottom portion and opposed sidewalls to form a laminated U-shaped cross-section;

a cover unit of shorter length than said base unit formed of laminated paperboard and having a top portion and opposed sidewalls to form a laminated U-shaped cross-section, said sidewalls of said base unit fitted within and embracing said sidewalls of said cover unit when said base unit and said cover unit are assembled as a container;

and a pair of end members closing off opposite ends of said container formed when said base unit and said cover unit are assembled, each of said end members having (a) a base portion and opposed sidewalls to form a laminated U-shaped cross-section, and (b) V-notches in its sidewalls with (i) a first length to one side of said V-notches fitted over said base unit with its sidewalls embracing the upper edges of the outside surfaces of the sidewalls of said base unit, and (ii) a second length to the other side of said V-notches folded downward from said first length to extend to said bottom portion of said base unit with its sidewalls embracing the end edges of the outside surfaces of the sidewalls of said base unit.

* * * * *

UNITED STATES PATENT AND TRADEMARK OFFICE

CERTIFICATE OF CORRECTION

PATENT NO. : 4,976,374

DATED : December 11, 1990

INVENTOR(S) : Vincent A. Macaluso

It is certified that error appears in the above—identified patent and that said Letters Patent is hereby corrected as shown below: Title page, items [56] and [57]:

In the References Cited: U. S. Patent Documents

Change second patent listed from "Mumsford" to --Mumford--,

In the Abstract

Last line, delete "area" and insert --are--.

Column 1, line 19, delete "or".

Column 3, line 3, delete "embodiment" and insert --and a third embodiment, respectively,--;

Column 3, line 5, delete "This embodiment differs" and insert --These embodiments differ--;

Column 3, line 7, delete "one version of this" and insert --the second--;

Column 3, line 19, delete "end caps 22" and insert --end caps 20--;

Column 3, line 20, delete "26" and insert --27--;

UNITED STATES PATENT AND TRADEMARK OFFICE

CERTIFICATE OF CORRECTION

PATENT NO. : 4,976,374

DATED : December 11, 1990

INVENTOR(S) : Vincent A. Macaluso

It is certified that error appears in the above—identified patent and that said Letters Patent is hereby corrected as shown below:

Column 3, line 41: delete "yet another version of the FIGS. 4 a nd 5" and insert --the third--;

Column 3, line 43: delete "dashed " and insert --solid--; and

Column 3, line 45: after "of" (first occurrence) insert --separate--.

In the Claims

Claim 8, Column 5, line 1: delete "opposite"; and

Claim 8, Column 5, line 2: after "off" insert --opposite--.

Signed and Sealed this

Seventh Day of June, 1994

*Attest:*

Bruce Lehman

BRUCE LEHMAN

*Attesting Officer*

*Commissioner of Patents and Trademarks*